US005342586A

United States Patent [19]

Park

[11] Patent Number: 5,342,586

[45] Date of Patent: Aug. 30, 1994

[54] COMBUSTION EFFICIENCY ENHANCING APPARATUS OF LIQUID FUEL

[75] Inventor: Jong H. Park, Seoul, Rep. of Korea

[73] Assignee: Samsung Electronics Co., Ltd., Suwon, Rep. of Korea

[21] Appl. No.: 945,872

[22] Filed: Sep. 17, 1992

[30] Foreign Application Priority Data

Sep. 17, 1991 [KR] Rep. of Korea ..... 91-15241[U]

[51] Int. Cl.[5] ..... F02P 1/00; F15C 1/04; F02M 33/00

[52] U.S. Cl. ..... 422/211; 123/538; 431/2

[58] Field of Search ..... 123/536, 538, 537, 590; 431/2; 422/211; 335/305

[56] References Cited

U.S. PATENT DOCUMENTS

| | | | |
|---|---|---|---|
| 3,909,299 | 9/1975 | Corrigan | 422/211 |
| 4,008,037 | 2/1977 | Hindin et al. | 431/2 |
| 4,297,983 | 11/1981 | Ward | 723/536 |
| 4,520,786 | 6/1985 | Thatcher et al. | 123/536 |
| 4,568,901 | 2/1986 | Adam | 335/305 |
| 4,711,271 | 12/1987 | Weisenbarger et al. | 123/538 |
| 5,069,190 | 12/1991 | Richards | 123/538 |
| 5,080,080 | 1/1992 | Melendrez | 123/538 |
| 5,124,045 | 6/1992 | Janczak et al. | 123/538 |
| 5,179,923 | 1/1993 | Tsurutani et al. | 123/590 |

*Primary Examiner*—E. Rollins Cross
*Assistant Examiner*—M. Macy
*Attorney, Agent, or Firm*—Burns, Doane, Swecker & Mathis

[57] ABSTRACT

A combustion efficiency enhancing apparatus for liquid fuel dissolves/ionizes liquid fuel and divides it into particles with microwaves. The apparatus deoxidizes the incomplete combustion materials with a catalyst and again ionizes the liquid fuel. The fuel flow of the particles is promoted, and the liquid fuel is burnt with a contact surface to oxygen which is relatively larger, thereby accomplishing complete combustion, enhancing the combustion efficiency and minimizing exhaust gas so as to reduce pollution.

8 Claims, 2 Drawing Sheets

FIG. 2
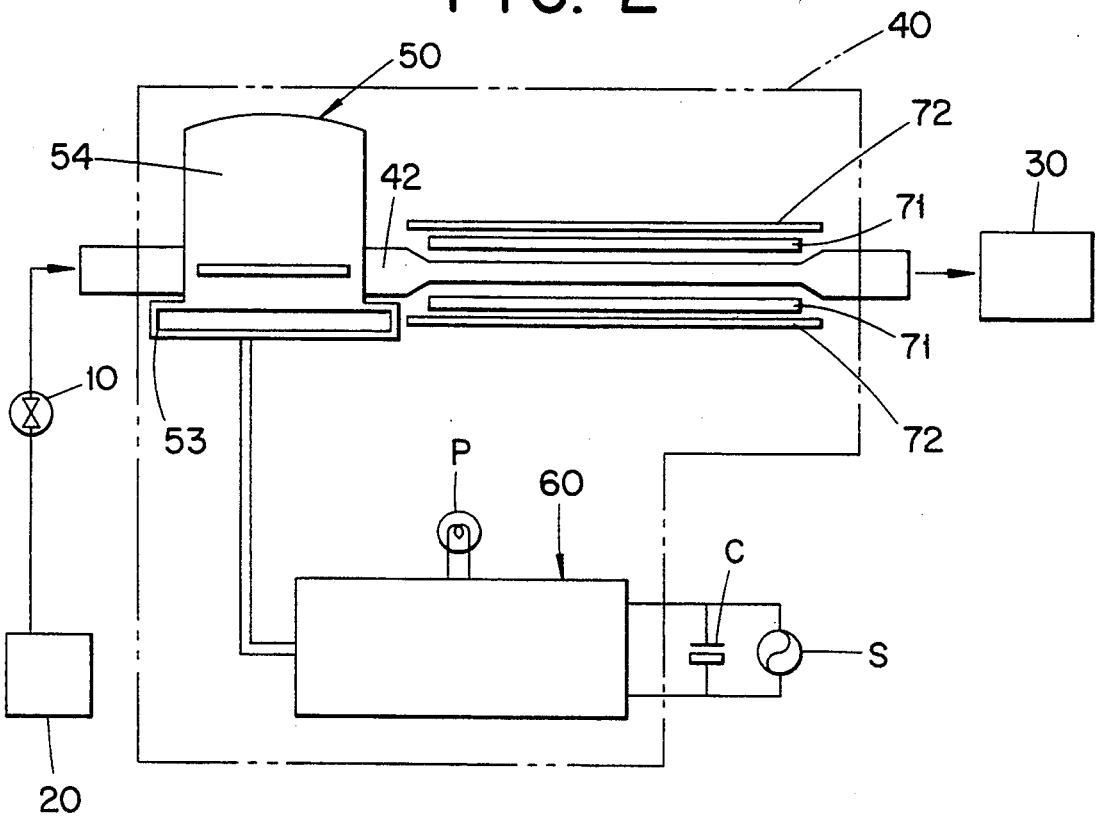
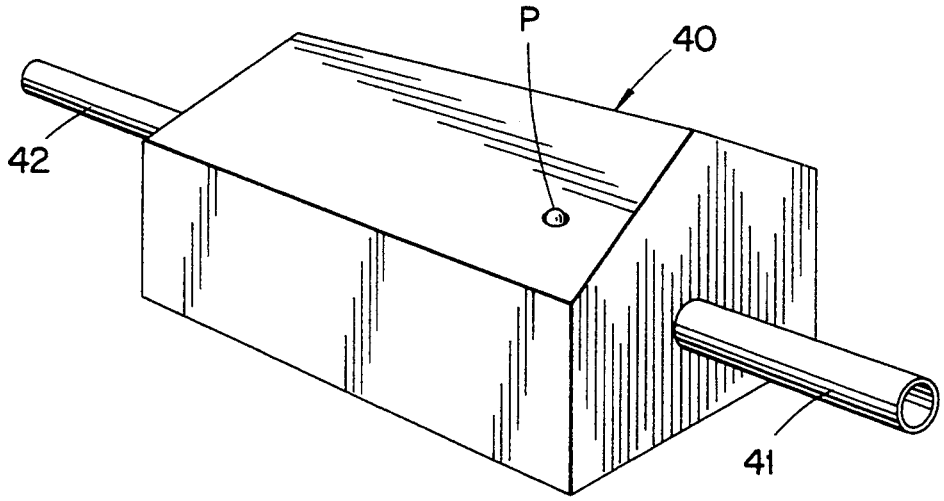
FIG. 3

COMBUSTION EFFICIENCY ENHANCING APPARATUS OF LIQUID FUEL

FIELD OF THE INVENTION

The present invention relates to a combustion efficiency enhancing apparatus for liquid fuel, and particularly, to an enhancing apparatus for ionizing liquid fuel at a high level and increasing its combustion efficiency.

BACKGROUND OF THE INVENTION

A conventional burner forces liquid fuel such as gasoline, kerosene and light oil to be compressed by a fuel pump and to be burnt in a jet like manner. It does not completely burn liquid fuel due to the incomplete combustion materials which are separate materials contained in the liquid fuel. In kerosene, paraffin particles are coupled with kerosene oil at a normal temperature of 5° C. to form an oil congregation. This congregation cannot be thoroughly disintegrated when jetted into the compressed condition, and this also serves as a factor causing incomplete combustion.

In the case of an automobile engine, incomplete combustion lowers the engine output during the explosion stroke; it causes the knocking phenomena; it increases the amount of fuel consumption; and it emits larger amounts of exhaust gas such as smoke pollution, thereby causing pollution.

In order to solve these problems, a complete combustion device has been devised to supply fuel mixed with preheated vapor gas or air. It was, however, inefficient due to the complexity of the system and excessive cost, and it was ineffective.

Nowadays, in order to obtain complete combustion in an automobile engine, the fuel is ionized as it passes through a magnetic field. This arrangement has a problem because the fuel ion dissolves at the magnetic field. This leads to a thermal phenomena reducing the complete combustion effect. This problem has not yet been solved. The possibility of an accident due to excessive heat is very high along with the great difficulty associated with its reliability. Such a device is disclosed in U.S. Pat. No. 4,568,901, issued to Mr. Adam, entitled "MAGNET FUEL ION MODIFIER". It is known that the ionization of fuel which is dependent upon a magnetic field has an unstable molecular configuration.

Accordingly, a main object of the present invention is to provide an apparatus for stabilizing the molecular configuration of liquid fuel and facilitating its change into a vapor during the ionization/segregation operation in order to enhance the combustion efficiency.

Another object of the present invention is to provide an apparatus for dissolving/deoxidizing the separate materials from liquid fuel in its burnable state in order to promote the complete combustion of fuel as well as to enhance the combustion efficiency. Another object of the present invention is to provide an apparatus for aligning the molecular configuration of liquid fuel into a stable state and ionizing it for the purpose of removing the separate materials from the fuel in order to enhance the combustion efficiency.

Still another object of the present invention is to provide an apparatus for dividing liquid fuel into particles by a predetermined size, forming it into a potential vapor state and again dividing it into further micro-particles during ionization in order to maximize the combustion efficiency.

SUMMARY OF THE INVENTION

In order to accomplish these objects and advantages, the present invention comprises a liquid fuel combustion efficiency enhancing apparatus mounted between a fuel pump and a fuel tank, which is provided with a liquid dividing apparatus, an oscillating frequency control portion and an ionizing apparatus.

The liquid dividing apparatus includes an inlet portion for introducing liquid fuel from a fuel tank and an outlet portion for discharging fuel toward the fuel pump. A body in the form of a dome for receiving liquid fuel communicates with the inlet and outlet portions. Means are installed in the lower portion of the body and electrically connected to the outer oscillating frequency control portion to generate microwaves. The microwaves divide liquid fuel into particles which are changeable into the vapor state. A catalyst means of the mesh type floats in the body and includes catalyst material for promoting the liquid fuel division.

The microwave generating means is electrically connected to an oscillating frequency generating circuit similar to the type used in a conventional humidifier for generating microwaves having a frequency of 1.6 MHz. The detailed description of the conventional oscillating frequency generating circuit is omitted, but it is only slightly different from the present invention which generates frequencies of 1.1 MHz to 1.2 MHz so as to accomplish the objects of the present invention. The microwave generating means divides the liquid fuel into particles having predetermined sizes of $5\mu$ to $10\mu$ which corresponds to a vapor state. The microwave generating means also ionizes the liquid fuel.

The catalyst means is made of an alloy of platinum and titanium or platinum and palladium and stabilizes the dissolution action of liquid fuel. The catalyst means also promotes its ionization ($O_3$) in order to deoxidize the separate materials contained in the liquid fuel.

The dome-type body has a cavity in the upper portion to receive the bubble phenomena caused by the vapor gas from the microwave generating means, thereby preventing the harmonic effect on the fuel surface and the breakdown of the microwave generating means. More particularly, the body is positioned on the way to the fuel pump, so that its inner portion is under suction in order to maintain the inner air atmospheric pressure at about 0.9 bar. Therefore, the life of the microwave generating means is almost permanent.

Furthermore, the body comprises a liquid fuel dividing chamber according to the present invention. The volume V of the body is changed according to the inflowing amount of fuel in such a manner that the cross-sectional area A is constant and the height is varied. The amount Q of liquid fuel determines the flow speed v in relation to the cross-sectional area S of the inlet and outlet portions. At this time, the flow speed v is equal to the amount of fuel passing through the body volume V per second.

If the fuel amount of 501 per hour is considered to be introduced through the inlet portion having the cross-sectional area of a diameter of 1 cm, the flow speed v is 176 m/sec. At this time, it is assumed that the diameter of the body is 3.6 cm, the height h of the body associated with the cross-sectional area A is determined as approximately 0.18 cm. Similarly, if the fuel amount is 251 per hour, the height h is approximately 0.08 cm. If the fuel amount is 0.41 per hour, the height h is approximately 0.0014 cm. Thus, the formula is established as SV=Ah. The height of the body satisfies the formula h=SV/A. The body is provided with an ionizing apparatus arranged on the outlet portion.

The ionizing apparatus is provided with a discharging pipe extending from the outlet portion of the body. The discharging pipe is flatly pressed at the upper and lower portions to increase the fuel flow speed. On both the flat surfaces of the pressed pipe are positioned two permanent magnets having their poles opposite each other. Otherwise, the permanent unit is formed from a number of pieces. These pieces are respectively provided with insulative materials inserted therebetween while being arranged in a paired configuration on the pressed surface. The poles of any pair of magnets are opposite to each other, and the adjacent pairs of magnets are continuous. Such permanent magnets are covered by insulative materials shielding the magnetic field.

Thus, the present invention enhances the combustion efficiency, saves fuel consumption and minimizes the pollution problem of exhaust gas. In other words, the present invention ionizes/divides the liquid fuel using the microwaves generated by a ceramic oscillating plate. A catalyst plate stabilizes the divided fuel as well as deoxidizes the separate materials. The magnetic field of the permanent magnets or the electrical field again ionizes the fuel supplied to the burner, thereby inducing the complete combustion of the fuel in order to enhance combustion efficiency.

Actual test results of the heat efficiency and complete combustion show the remarkable effects of the present invention. The test was conducted on a fan heater and a rotary heater, each of which was operated for 108 hours using a 50% fuel mixture of kerosene and light oil. As a result, the fan heater left a little tar, and the rotary heater did not leave any tar. The amount of fuel discharged was increased approximately 20%, and the heating calories were increased by about 25.

Therefore, it should be noted that the present invention may be adapted for use in an automobile engine, a marine engine or an industrial boiler using a liquid fuel such as gasoline, kerosene and light oil. The heat efficiency enhancement, the fuel consumption savings and the increased engine output from the complete combustion can prevent the knocking phenomena and leads to the reduction of exhaust gas in an automobile engine.

BRIEF DESCRIPTION OF THE DRAWINGS

The present invention will be explained in detail with reference to the accompanying drawings, in which:

FIG. 2 is a schematic block diagram showing the installation of a combustion efficiency enhancing apparatus for liquid fuel according to the present invention; and, FIG. 3 is a perspective view of a combustion efficiency enhancing apparatus for liquid fuel constructed according to the present invention.

DETAILED DESCRIPTION OF THE INVENTION

Figure 1:
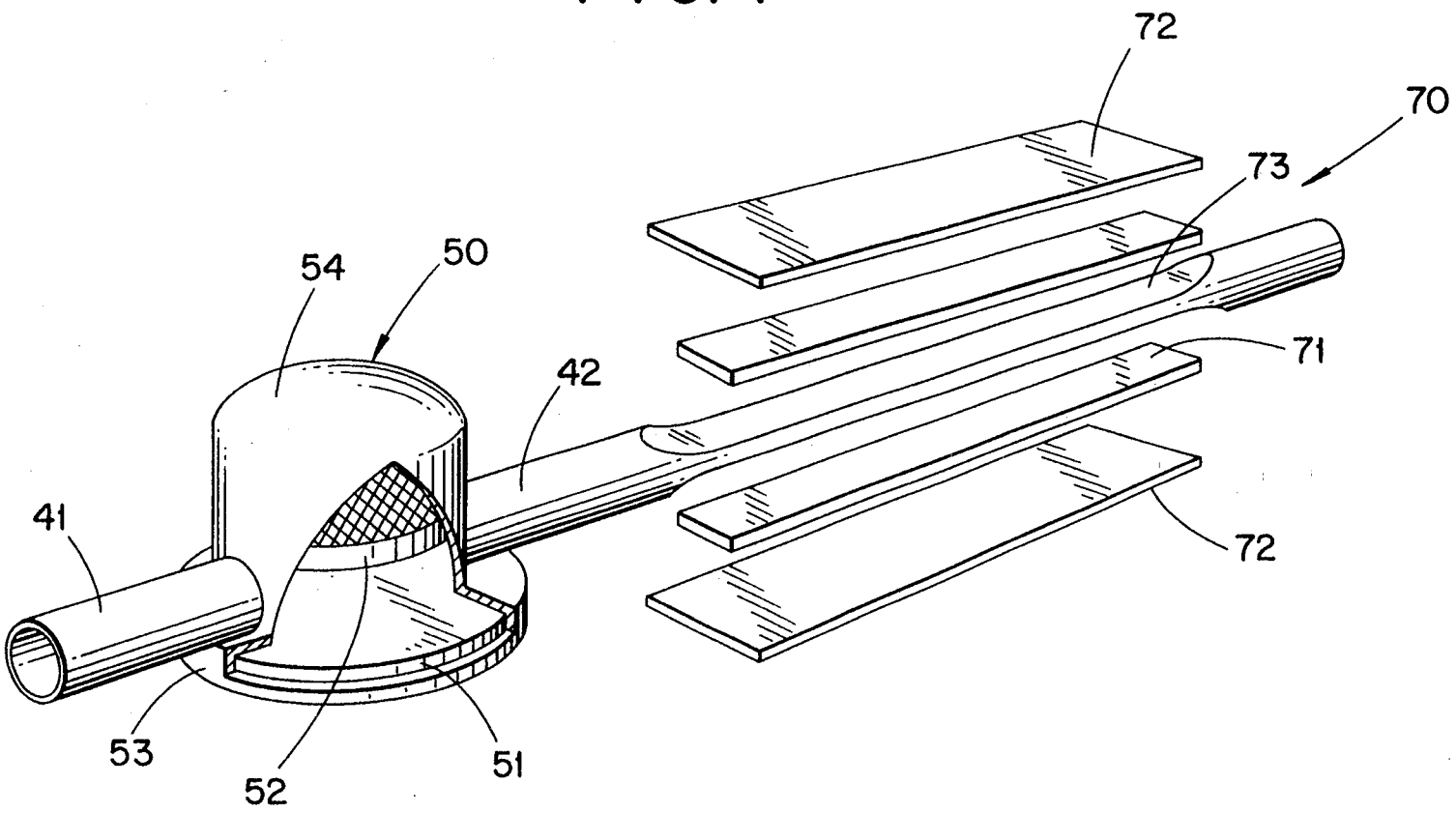
FIG. 1 is an exploded perspective view showing a combustion efficiency enhancing apparatus for liquid fuel, constructed according to the present invention.

Referring to the drawings and FIG. 2 in particular, the present invention comprises a combustion efficiency enhancing apparatus for liquid fuel 40, which is installed between a fuel tank 20 and a burner 30. A fuel pump, which is not shown in the drawings, is positioned between the combustion efficiency enhancing apparatus 40 and the burner 30, so that liquid fuel is inhaled from the combustion efficiency enhancing apparatus 40 to the fuel pump, thereby keeping the inner air atmosphere pressure of a body 54 as described later at 0.9 bar. Therefore, liquid fuel is supplied by the fuel pump to the burner 30 via a valve 10 and the combustion efficiency enhancing apparatus 40.

The combustion efficiency enhancing apparatus 40 comprises a liquid dividing apparatus 50, a microwave generating control portion 60 and an ionizing apparatus 70. The liquid dividing apparatus 50 is provided with a receptacle 53 receiving a microwave generator 51 and a cylindrical body of a dome type. The body 54 is provided with an inlet pipe 41 connected to its inlet portion and an outlet pipe 42 coupled to its outlet portion. The receptacle 53 is formed at the lower larger portion of the body 54 to receive the microwave generator 51 which includes a circular ceramic oscillating plate. Also, the body 54 has a catalyst plate 52 floating therein during the fuel inflow.

The catalyst plate 52 is in the form of a mesh type and made of an alloy of platinum and titanium or platinum and palladium. It should be noted that the dome-type body 54 has a cavity at the upper portion to cause the bubble phenomena of liquid fuel associated with microwaves, thereby preventing the breakdown of the microwave generator 51. The microwave generator 51 is electrically connected to the oscillating frequency control portion 60 for controlling its oscillating operation.

The oscillating frequency control portion 60 is designed to generate a frequency of approximately 1.1 MHz to 1.2 MHz, which may be provided with a condenser C, a power source S and a pilot lamp P as shown in the drawings. The pilot lamp P permits users to identify the operation of the combustion efficiency enhancing apparatus 40 from the outside.

The ionizing apparatus 70 includes the outlet pipe 42. The outlet pipe 42 is lengthwise extended by a predetermined distance, the upper and lower portions of which are pressed to have flat surfaces 73, respectively. On the flat surface are arranged a pair of permanent magnets or a plurality of paired permanent magnets which have their poles opposite each other. The outer circumferential portion of the permanent magnet are covered by at least two shielding plates 72 made of an insulative material to prevent the outward leakage of the magnetic field.

Therefore, in the present invention liquid fuel is introduced through an inlet pipe 41 into a body 54. The liquid fuel is divided into particles having a predetermined size, for example $5\mu$–$10\mu$, by a microwave generator 51 electrically connected to an oscillating frequency control portion 60. At this time, separate materials, which are considered to be impurity materials contained in the liquid fuel, are broken up into micro-particles while being ionized. The catalyst plate 52 promotes the ionization action of the microwaves in order to increase the amount of ozone $O_3$. The separate materials are deoxidized by ions, and the divided liquid is stabilized. Thereafter, the liquid fuel is again compressed/ionized by the magnetic field passing through the ionizing apparatus 70. The liquid fuel is divided into further micro-particles, and it is then fed to the burner 30.

According to the present invention, a combustion efficiency enhancing apparatus for liquid fuel dissolves/ionizes the liquid fuel and divides it into particles using microwaves. It deoxidizes the incomplete combustion materials with a catalyst, and it again ionizes the liquid fuel. The particle fuel flow is promoted, and the liquid fuel is burnt by having its contact surface to oxygen being made relatively larger. The present invention accomplishes complete combustion, enhances the combustion efficiency and minimizes exhaust gas in order to reduce pollution. When the present invention is adapted to an automobile combustion engine, it increases the engine output, reduces engine noise, removes exhaust gas, prevents knocking, saves consumption, and extends engine life. Particularly, when the present invention is adapted to a combustion engine using kerosene, it divides paraffin contained in the fuel into particles and deoxidizes it with ions from the catalyst in order to burn it in the burner, thereby leading to the complete combustion of the fuel.

As described above, the present invention has a simple configuration to facilitate its construction, and its volume and size is very compact in order to easily install it on a fuel supply line. It is reliable in addition to its practicality and its usefulness.

What is claimed is:

1. A combustion efficiency enhancing apparatus of liquid fuel, comprising:

a body;

means for generating microwave energy in said body in order to divide the liquid fuel into particles;

a catalyst disposed in said body;

means for compressing the particles discharged from said body; and means for forming a magnetic field, the magnetic field ionizing the particles discharged from said body.

2. A combustion efficiency enhancing apparatus according to claim 1 wherein the means for generating microwave energy includes control means for generating microwaves having a frequency of 1.1 MHz to 1.2 MHz.

3. A combustion efficiency enhancing apparatus according to claim 1 wherein the means for generating microwave energy includes an oscillating ceramic plate.

4. A combustion efficiency enhancing apparatus according to claim 1 wherein the catalyst is selected from the group comprising platinum and titanium or platinum and palladium.

5. A combustion efficiency enhancing apparatus according to claim 1 wherein the body is of a dome type.

6. A combustion efficiency enhancing apparatus according to claim 1 wherein the means for compressing includes a pipe having flat surfaces.

7. A combustion efficiency enhancing apparatus according to claim 1 wherein the means for forming the magnetic field includes a pair of permanent magnets having their poles opposite each other.

8. A combustion efficiency enhancing apparatus according to claim 1 wherein the means for forming the magnetic field includes pairs of magnets, the poles of any pair of magnets being opposite to each other and the adjacent pair of magnets being arranged continuously.

* * * * *